US006585028B2

(12) United States Patent
Verdicchio

(10) Patent No.: US 6,585,028 B2
(45) Date of Patent: Jul. 1, 2003

(54) MODULAR WALL SYSTEM

(76) Inventor: Richard Verdicchio, 1977 Queen Street East, Toronto, Ontario (CA), M4L 1J1

( * ) Notice: Subject to any disclaimer, the term of this patent is extended or adjusted under 35 U.S.C. 154(b) by 0 days.

(21) Appl. No.: 09/893,492

(22) Filed: Jun. 29, 2001

(65) Prior Publication Data

US 2003/0000659 A1 Jan. 2, 2003

(51) Int. Cl.[7] ..... A47G 5/00
(52) U.S. Cl. ..... 160/351; 52/239
(58) Field of Search ..... 160/135, 351, 160/352; 52/239

(56) References Cited

U.S. PATENT DOCUMENTS 2,917,188 A * 12/1959 Menin ..... 160/135
2,970,396 A * 2/1961 Worrell ..... 160/135
3,204,689 A * 9/1965 Howell ..... 160/135
3,571,999 A * 3/1971 Downing ..... 160/135 X
3,913,656 A * 10/1975 Guyer ..... 160/135
4,056,903 A * 11/1977 Guarnere ..... 160/135 X
4,865,111 A * 9/1989 Perutz ..... 160/135
5,375,641 A * 12/1994 Schlueter ..... 160/135

* cited by examiner

*Primary Examiner*—David M. Purol
(74) *Attorney, Agent, or Firm*—Ridout & Maybee LLP; Randall S. Mitchell

(57) ABSTRACT

A modular building system is disclosed for forming at least one dissassemblable, freestanding screen, the system comprising at least two elongate supports each having an upper end and a lower end, a foot for each of the support members to hold the support members stably in a vertical position and plurality of building blocks adapted to be threaded in vertical progression on the support members, stackable one upon another to form a screen. There is thereby provided a versatile building system for screens, particularly those to be used to partition room space, which are adjustable in height and easily disassembled for reconfiguration.

8 Claims, 5 Drawing Sheets

TOP VIEW

FRONT VIEW

END VIEW

STACKING

MODULAR WALL SYSTEM

FIELD OF THE INVENTION

This invention relates to a modular building system for freestanding screens or room dividers. Especially the invention relates to a modular building system for freestanding screens of the type used to partition space into discrete areas such as, for example, screens used for partition office space into typing bays and other work areas.

Freestanding screens or room dividers are frequently formed by integral vertical panels supported vertically by a stand. Such panels may either be solid, for example particle board panels or they may comprise a front panel and a back panel having air space or filling such as insulation between them. Whether the panels are solid or spaced apart panels it is usually necessary for aesthetic purposes to provide an edging around the screen. Sometimes such edging may incorporate linking means to link adjacent panels. The front and back surfaces of such panels may be decorated by any convenient means, frequently by fabric covering.

Although screens of different heights and widths may be provided by utilizing panels of different sizes, it is not possible to adjust the height of any one particular screen Moreover, although a wide variety of decorative finishing surfaces and side edging may be used, the provision of such finishes adds considerably to the cost of the article. Less importantly, if such screens are to be stored, they take up considerable storage space unless they may be disassembled from their stands. Even if it is possible to disassemble the panels from the stands, the panels must be either stacked vertically against a wall or flat on the floor. In either case considerable floor space or wall space is required for storage.

SUMMARY OF THE INVENTION

The present inventor has attempted to provide a versatile building system for screens, especially those to be used to partition space, which screens may be adjustable in height and easily disassembled for reconfiguration.

According to the invention there is provided a modular building system to form at least one dissassemblable, freestanding screen, the system comprising at least two elongate supports each having an upper end and a lower end, a foot for each of the support members to hold the support member stably in a vertical position, the lower end of each support member being engagable with one of the feet; a plurality of building blocks stackable one upon another to form a screen. The stacked blocks to be threaded in vertical progression on the support members, each building block comprising a rectangular box having an open bottom and an open top.

Preferably the building blocks engage one with another by means of members upstanding from opposed inner surfaces of one building block to project into and fit against opposed inner surfaces of another building block stacked on it. The upstanding members may conveniently be formed by profiling upper and lower margins to form interengaging steps. Alternatively inner lining walls may be provided against opposed inner wall surfaces of each building block. Inner lining walls fixed to opposed inner end wall surfaces may be provided with handles to aid manipulation of the building blocks.

The system may include an uppermost capping member comprising a rectangular box having an open bottom and a closed top the dimensions of the capping member being such as to latch into the building block immediately below it. Preferably, the upper surface of each building block is bevelled downwardly and inwardly. When a capping member is used above one of these building blocks, the dimensions of the capping member may be such that the capping member nests in the building block supported by the bevelled surface.

The support members may be telescopic so that their height may be adjustable.

Transverse strut members may be provided within the building blocks to provide them with some rigidity. The building blocks may also be provided with open ended sockets from top to bottom for sliding fit about the support members.

When assembling a building system according to the invention into a freestanding screen the steps may generally be as follows:

1) The lower ends of two support members are engaged into corresponding feet;
2) If the height of the support members is adjustable these are now adjusted to the height required;
3) A lowermost building block is threaded onto the support members through the sockets in the building block provided for that purpose and the building block is lowered to rest on the feet;
4) A further building block is threaded onto the support members and lowered onto the lowermost building block;
5) Further building blocks are added until the screen has nearly reached the desired height;
6) The stacked building blocks are retained in the stack by means of engagement means between the uppermost building block and each of the supports;
7) Finally a capping member is placed over the top end of the support to nest on the uppermost building block.

BRIEF DESCRIPTION OF THE DRAWINGS

Embodiments of the invention will now be described with reference to the drawings in which.

DETAILED DESCRIPTION OF THE INVENTION

Figure 1:
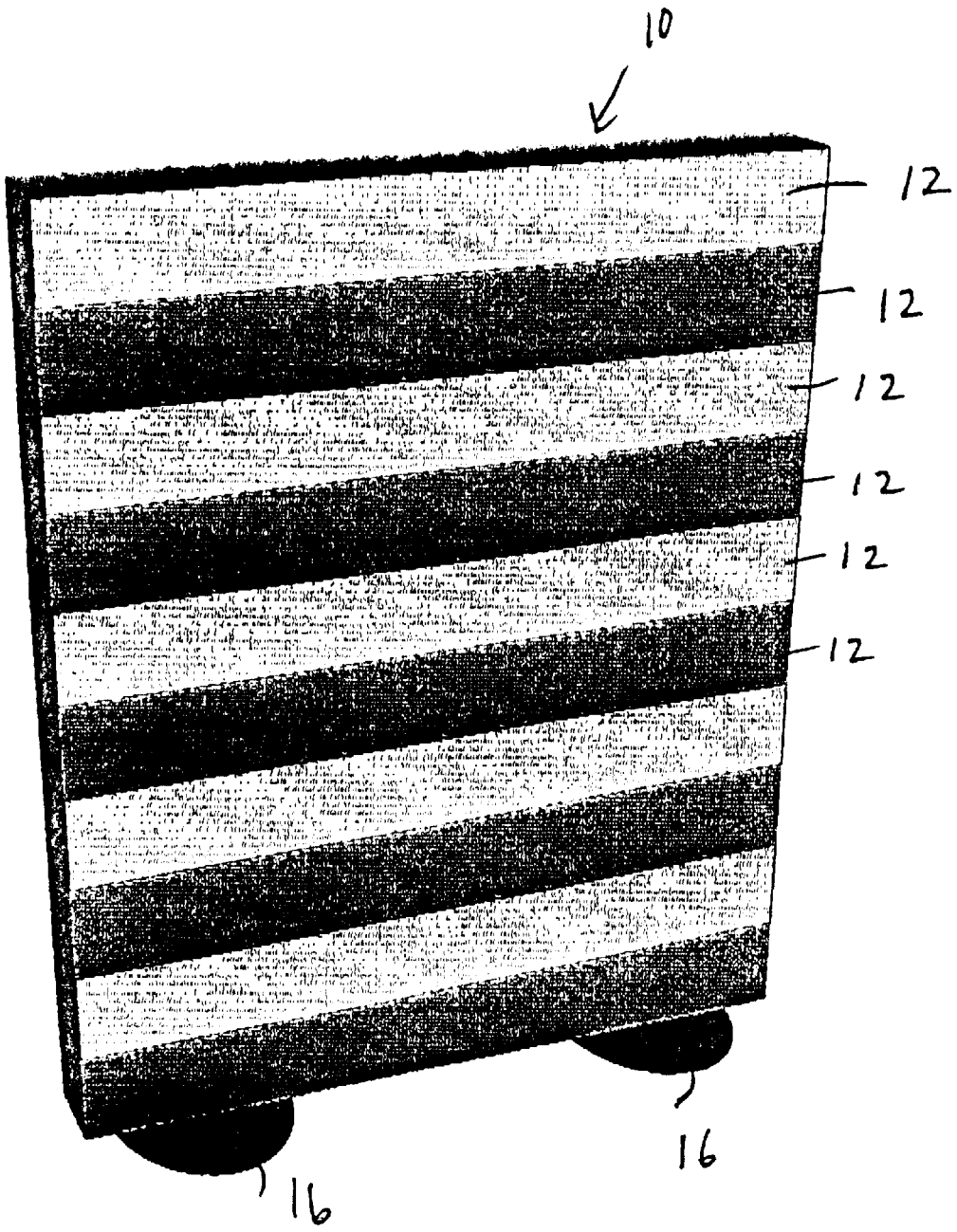
FIG. 1 shows a room dividing partition screen made up from a system according to the invention.

The drawings show a room dividing partition screen 10 made up of building blocks 12 and vertical supports 14. The screen 10 is a freestanding single unit as shown in FIG. 1. The partition screen 10 comprises building blocks 12 stacked to any desired height.

Figure 2:
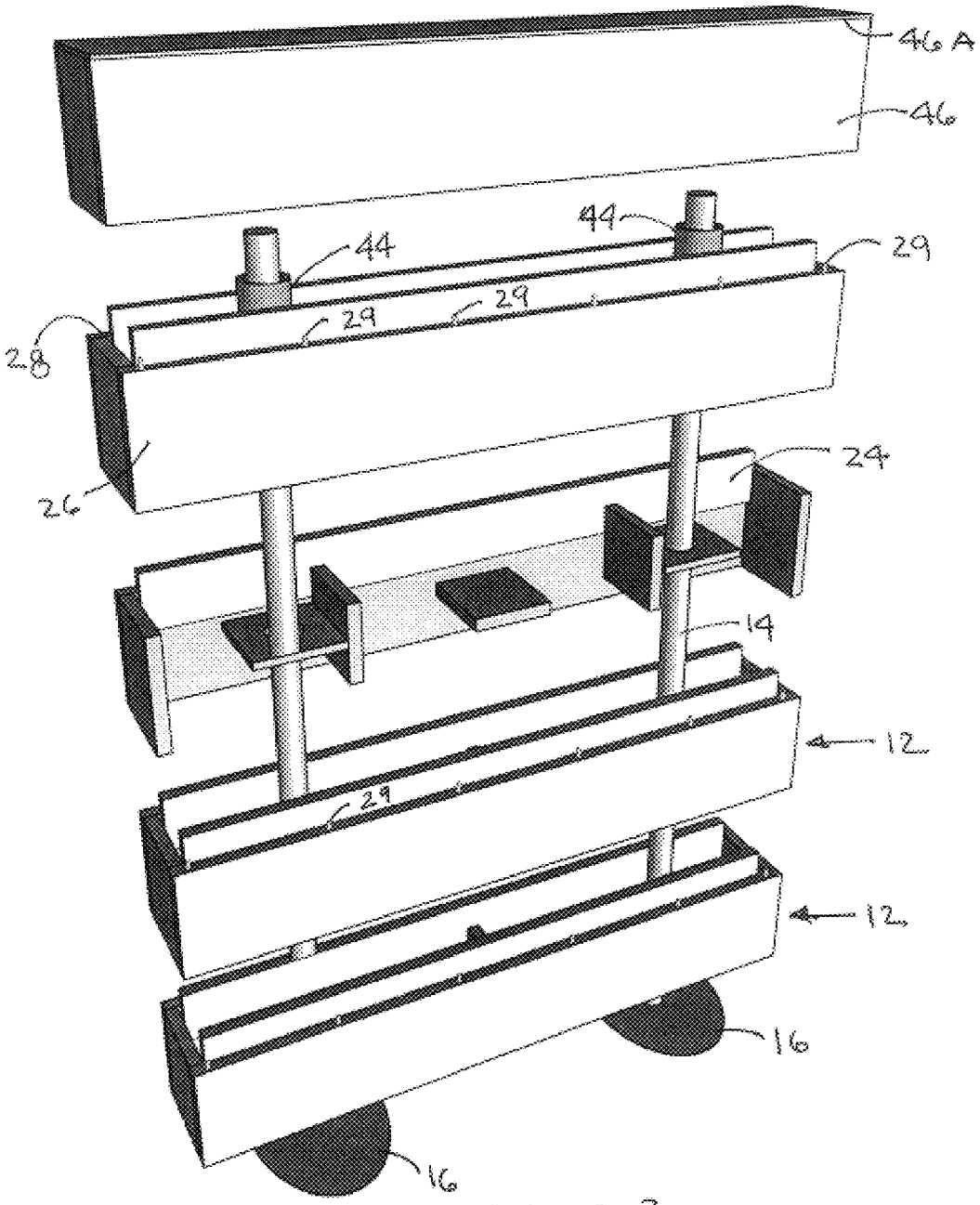
FIG. 2 shows the room dividing partition screen of FIG. 1 as an exploded view showing details of the building blocks.

As may be best seen from FIG. 2 the system may comprise, for each screen 10, a pair of elongate support members 14 to be held in a vertical position by feet 16. Usually a pair of support members 14 with feet 16 is sufficient for any one screen. For example a pair of feet 16 will support a screen of up to 8 feet in width. If a very wide screen is desired, it may sometime be desirable to have more than two support members.

Figure 3A:
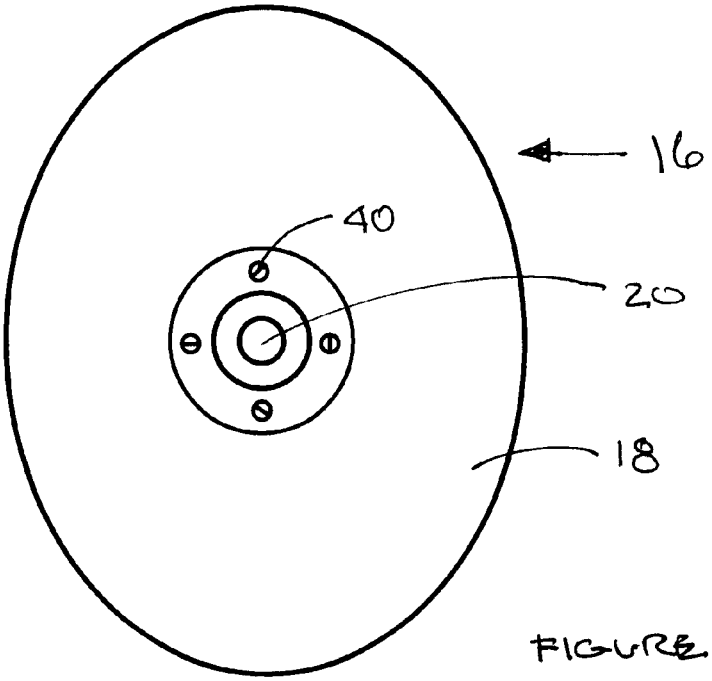
FIGS. 3(*a*) and 3(*b*) are a view of a foot in a building system according to the invention.
Figure 3B:
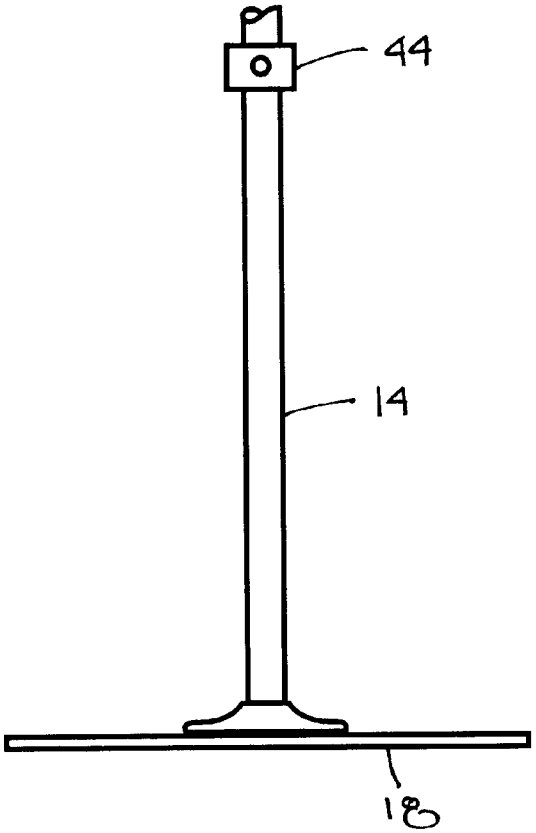

Feet 16, illustrated in FIGS. 3(*a*) and 3(*b*), may be of any convenient shape and size but generally extend horizontally at right angles to the plane of screen 10 to give it stability in the vertical plane. Conveniently, the feet may have the form illustrated in FIG. 3 being generally elliptical in plan view having a flat lower surface with the major axis of the ellipse extending horizontally at right angles to the plane of the screen. The elliptical base 18 may have a separate round or elliptical neck 20 having a socket 22 in an upper surface. Alternatively the base may be one piece with the neck merging into it. The socket 22 is designed to mate with a lower end of one of the supports 14. Thus, if the support is of round cross section, then the socket will be of round cross section having a similar diameter. If the support is of square or of other cross section the socket will have a shape corresponding to it.

The supports 14, themselves, have a length generally corresponding to the desired height of the screen 10. In order that the support members 14 lodge securely in sockets of building units 12 in a manner to be hereinafter described, it is desirable that the outer surface of supports 14 be continuous. Thus, supports 14 may be supplied in different lengths according to customer requirements. Alternatively, supports 14 may be supplied in lengths considered adequate for most purposes and may be cut to shorter lengths by the customer if required. Alternatively, supports 14 may be made telescopic but when telescopic supports are provided it may be difficult to provide a continuous outer surface of constant diameter.

Figure 4:
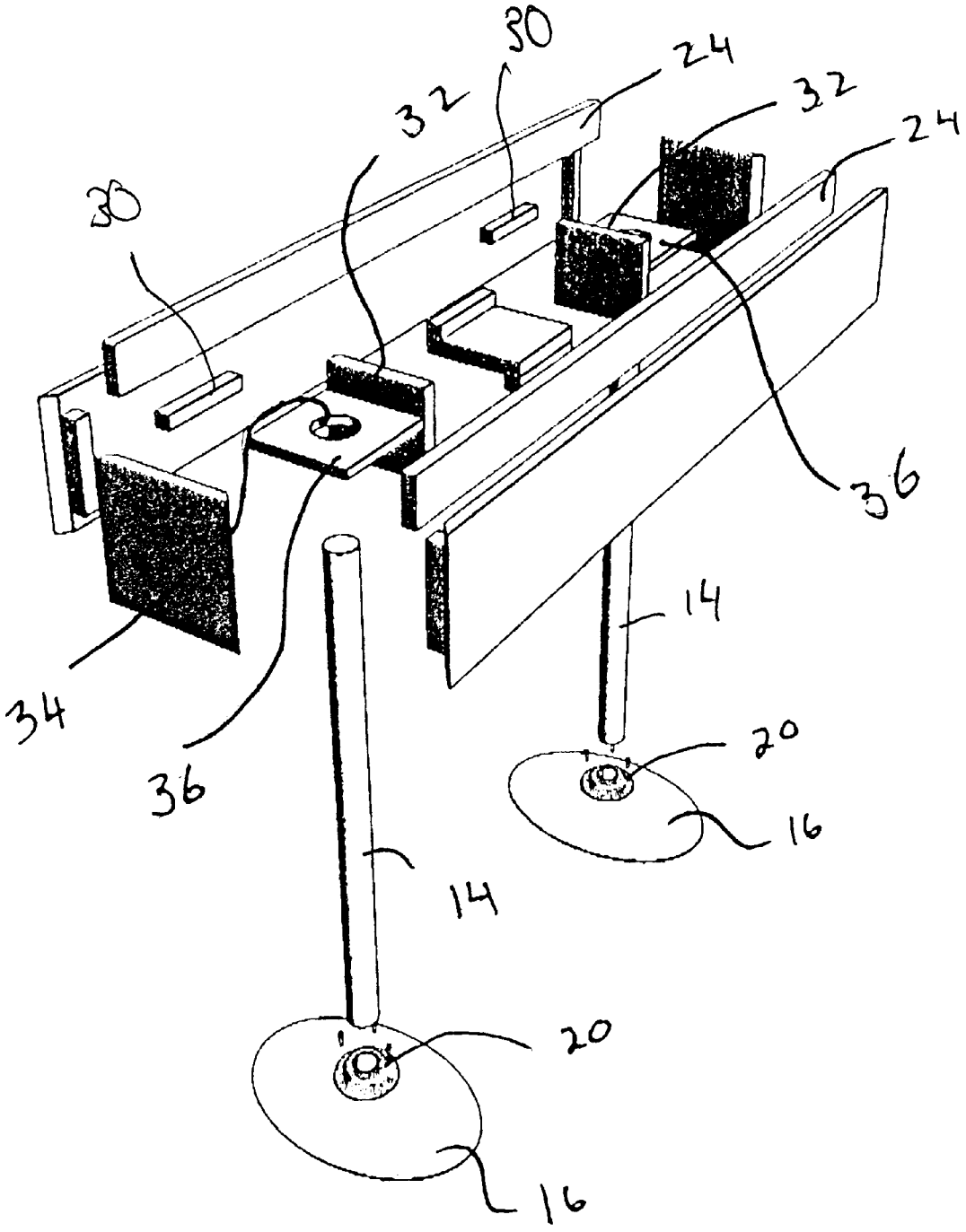
FIG. 4 shows the interior of a stacking building unit according to the invention.

Each building block 12 may comprise a rectangular box having an open top and an open bottom. Each box may be formed of fibre board, chip board, pressed wood, wood or any other convenient material. The boxes or building units 12 may be assembled into the final screen 10 by stacking one box upon another so that the lower edge of one box rests on the upper box of the other. Engagement means should be provided between the boxes to prevent or inhibit relative movement between them. The engagement means may be any convenient means but preferably should be provided inwardly of the boxes so as not to present any unsightly appearance on the outside. For example, as may be seen from FIGS. 2 and 4, the engagement means may be a rigid liner 24 upstanding from an inner surface of a lower box 12 to project into and position an upper box 12 immediately above it. As shown, liners 24 extend fully along both long walls 26 of the box 12. The liner 24 may only extend over one pair of opposed walls as shown. Alternatively the liner 24 may extend over long side walls 26 and over short end walls 28.

Alternatively, or additionally to the liner engagement means a series of positioning pegs 29 may extend upwardly from the upper edge surface of a lower box to position an upper box upon it, by fitting into a matting series of holes (not shown) in the lower edge surface of the upper box.

The liners 24 may conveniently comprise elongate boards to rest on ledges 30 projecting inwardly from inner surfaces of long walls 26. The liners fit loosely against the inner surfaces of long walls 26 and may be prevented from tipping inwardly by rectangular spacer plates 32 extending across each box 12 between the liners 24. Each spacer plate 32 of the lowermost box 12 rests on the top edge of neck 20 of foot 16. Each spacer plate 32 of boxes 12 above the lowermost box rest on the spacer plate 32 immediately below it.

Each spacer plate 32 has an extension 36 having an axially vertical socket therethrough for the passage of elongate vertical supports 14. Conveniently each extension 36 is a horizontal plate extending from the spacer plate 32, the horizontal plate 36 having an aperture 34 therethrough, the aperture corresponding in shape to the perimeter of the corresponding support 14.

When the liner 24 is a full liner or when it is over opposed short walls 28, it may be convenient to provide it with handles for easy manipulation of the building units or boxes 12. These handles may conveniently be formed of apertures in the liner. The liner 24 itself, may be formed from a similar material, i.e. fibre board, chip board, wood, etc, as the outer structure of box 12 or it may be formed of other rigid material capable of locating one box on top of another. Other possible materials are metal sheet, plastic sheet, etc.

Figure 5:
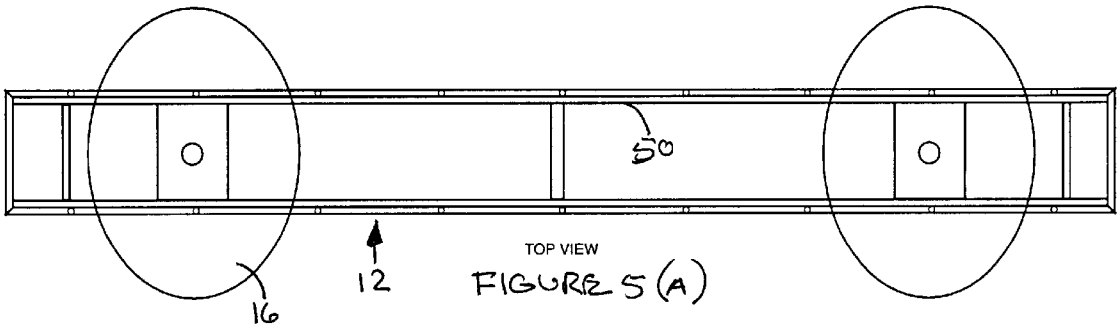
FIGS. 5(*a*) to 5(*d*) are drawings of an embodiment of the invention showing preferred features.
Figure 5:
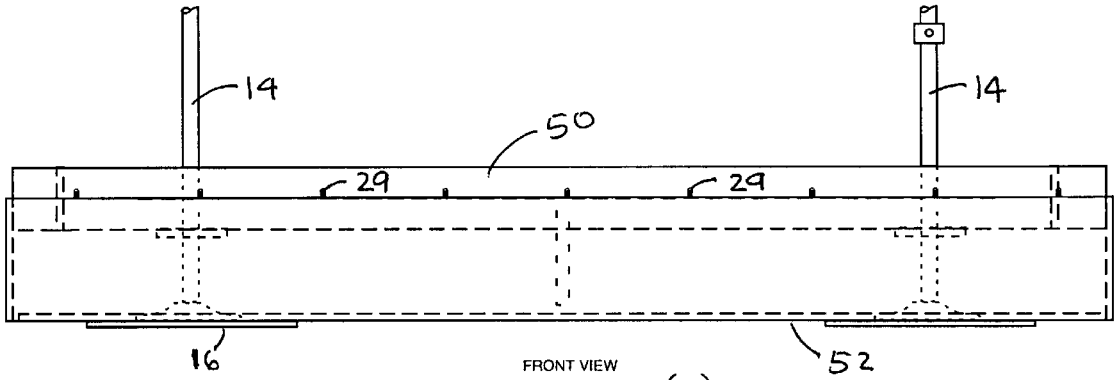
Figure 5C:
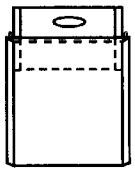
Figure 5D:
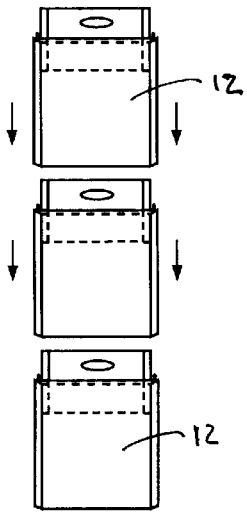

Alternatively as may be seen from FIG. 5, an upper margin of the outer surface of a building block 12 may be profiled by a right angled elongate groove to provide an inwardly stepped, upwardly directed flange or guide rail 50. Similarly, a lower margin of a building block 12 may be profiled with an elongate right angled groove to provide a downwardly directed flange or skirt 52 to fit over flange 50. The arrangement of notches and flanges may be such that the groove and tongue engagement between building units is achieved.

In assembly, lower ends of supports 14 are nested into sockets 22 of feet 16 and fixed firmly therein. Sockets 22 may be made of distortable plastic material screwed onto foot base 18 by screws 40. As screws 40 are tightened, neck 20 tends to tighten about support 14.

Thereafter, a lowermost building unit or box 12 is slotted onto supports 14 through sockets 34 of plates 36. The lowermost box 12 is slid down the supports 14 to rest on the upper surface of neck 20 of foot 16. The dimensions of the upper surface of neck 20 should be sufficiently great to allow box 12 to rest thereon. Spacer plates 32 and liners 24 are placed in position with socket 34 of extension plate 36 about support 14.

Thereafter a further box 12 is slotted onto supports 14 and slid down them to rest on the upper edge of the lowermost box 12. Further liners and spacer plates are added, followed by further boxes 12 as required. When the structure (partition screen 10) has nearly sufficient desired height, locking clamps 44 are placed on supports 14 and tightened to hold the boxes 12 in position and allow the screen to be transported as a unit.

Finally, a cap member 46 is placed over the uppermost box 12 to hide the top of supports 14 and the locking clamps 44. The cap member is generally similar in shape to the boxes 12 but may have a closed top surface 46*a*.

Conveniently, each of the boxes 12 may have bevelled upper and lower edges 48, the bevel extending downwardly and inwardly for vertical nesting engagement of adjacent boxes in a stack. The dimension of cap member 46 may be such that the cap member rests on the bevel to nest slightly within uppermost box 12. This member cap member 46, although it rests loosely on the uppermost box 12, may be retained stably in position by means of this slight nesting.

The boxes may be painted or otherwise finished according to customer requirements. When not in use they may be stored in any convenient format. If stored on their sides they may even provide convenient storage capacity for other small items.

What is claimed is:

1. Dissassemblable freestanding partition screen, comprising:

at least two elongate support members, each having an upper end and a lower end;

a foot for each of said support members, adapted to engage the lower end of one support member and hold said one support member erect in vertical orientation; and a plurality of vertically stackable building block members, each said building block member being a rectangular box open at the bottom and top thereof, comprising a front wall, a rear wall and a horizontal bracing means, each said building block member including socket means for receiving respective upper ends of the support members through apertures in said horizontal bracing means when the support members are placed in a predetermined transverse alignment, each said building block member including integral engagement means at the top and bottom thereof for engagement with the building block members immediately above and below said building block member in a vertical stack on the support members for resisting relative lateral movement of the building block members of the stack.

2. A partition screen according to claim 1, further comprising means for reversibly locking a box to said support members following placement of that box in its position in said vertical stacked arrangement, so that the complete assembly of building blocks in said stacked arrangement can be lifted and transported as a unit.

3. A partition screen according to claim 2, wherein said engagement means comprise linear panels extending between opposed inner surfaces of said front and rear walls for mating engagement against the inner surfaces of the corresponding front and rear walls of an overlying building block in a vertical stack.

4. A partition screen according to claim 2, wherein said engagement means comprise positioning pegs projecting upwardly from upper edge surfaces of each box and mating holes recessed into lower edge surfaces of each box, for engagement between abutting box edge surfaces in the vertical stack.

5. A partition screen according to claim 2, wherein said engagement means comprises matingly bevelled upper and lower edge surfaces of said building block members for nesting engagement of the bottom portion of a box in a vertical stack with the top of the box immediately below it.

6. A partition screen according to claim 3, wherein the inner wall surfaces of each box include integral ledges positioned for abutment against top edge surfaces of the linear panels of the underlying box in a vertical stack.

7. A partition screen according to any one of claims 2 to 6, wherein said horizontal bracing means comprises a rectangular spacer plate extending horizontally across the interior of each building block between the front and rear walls thereof.

8. A partition screen according to claim 7, wherein said socket means comprises holes through said spacer plate positioned and dimensioned for accommodation of said vertical supports, to permit sliding movement of a box therealong while preventing lateral movement.

* * * * *